United States Patent [19]

Bemis et al.

[11] 4,264,223

[45] Apr. 28, 1981

[54] REVERSIBLE RIBBON CARTRIDGE FOR A HIGH SPEED IMPACT PRINTER

[75] Inventors: John D. Bemis; Rowland V. D. Firth, III; Willie Goff, Jr.; Richard T. Stone, Jr., all of Austin, Tex.

[73] Assignee: International Business Machines Corporation, Armonk, N.Y.

[21] Appl. No.: 233

[22] Filed: Jan. 2, 1979

[51] Int. Cl.[3] ..... B41J 33/14

[52] U.S. Cl. ..... 400/208; 400/211; 400/217; 400/223; 400/236; 242/199

[58] Field of Search ..... 400/206, 208, 211, 216, 400/216.2, 217, 219, 223, 236; 242/71.2, 75.1, 192, 197, 198, 199, 200; 354/275; 206/387; 226/171, 172

[56] References Cited

U.S. PATENT DOCUMENTS

| | | | |
|---|---|---|---|
| 609,476 | 8/1898 | Stickney | 400/219 |
| 2,203,168 | 6/1940 | Long | 400/223 X |
| 2,278,009 | 3/1942 | Handley | 400/206 X |
| 2,940,577 | 6/1960 | Smallwood | 400/216 |
| 2,986,260 | 5/1961 | Whippo | 400/208 |
| 3,110,215 | 11/1963 | Jenkins et al. | 242/71.2 X |
| 3,481,445 | 12/1969 | Engle et al. | 400/208 |
| 3,650,378 | 3/1972 | Kakiuchi et al. | 206/387 |
| 3,915,409 | 10/1975 | Satou | 242/199 |
| 4,160,605 | 7/1979 | Neubaum | 354/275 X |

FOREIGN PATENT DOCUMENTS

| | | | |
|---|---|---|---|
| 2515899 | 10/1976 | Fed. Rep. of Germany | 400/208 |

*Primary Examiner*—Ernest T. Wright, Jr.
*Attorney, Agent, or Firm*—J. B. Kraft

[57] ABSTRACT

In a high speed impact printer having means for receiving a ribbon cartridge and for driving the ribbon in said cartridge, the improved apparatus comprising a ribbon cartridge to be inserted in said receiving means and adapted to be reversed one time only which comprises a cartridge housing with first and second reels rotatably mounted in said housing; each of the reels is adapted to support a portion of inventory of a ribbon web which is being driven from one reel to the other reel by the impact printer means for driving said ribbon. A keyed tenon projects from said housing and has an initial position and a second position; the keyed tenon is switchable from the initial position to the second position but irreversible from said second position. The receiving means in the printer includes means for exclusively receiving the tenon keyed in its initial position wherein the ribbon is driven from the first reel to the second reel and means for exclusively receiving the keyed tenon in its second position wherein ribbon is driven from the second reel to the first reel.

7 Claims, 8 Drawing Figures

REVERSIBLE RIBBON CARTRIDGE FOR A HIGH SPEED IMPACT PRINTER

DESCRIPTION

BACKGROUND OF THE INVENTION

1. Field of the Invention

This invention relates to impact printers. More specifically, it relates to a ribbon cartridge for impact printers.

2. Description of Prior Art

With the development of the printer field in the direction of high speed impact printers producing high quality printing suitable for correspondence at high speed in the order of 60 cycles per second, new needs have arisen with respect to printer ribbon structures and drive mechanisms.

Because of the high throughput of such printer apparatus and the consequently high volume of printed characters, the art has had to provide a ribbon which is of relatively low cost but yet provides high quality printing. Because of the difficulty in meeting these requirements with the more traditional fabric base or carbon film ribbons, the art has been working with a more recent type of ribbon which is a cast matrix of a plastic such as nylon containing liquid ink. While such ribbon structures appear to provide the combination of high quality printing and low cost, they are highly distortable and fragile. Further, they are sensitive to high temperature and high humidity. For example, at temperatures in the order of 25° C. and 80% relative humidity, as little as 30 grams of ribbon tension may cause objectionable yielding and frequent breakage of a cast matrix type of ribbon which is in the order of 0.6 cm. wide.

In addition, because of the highly fragile nature of the ribbon, the ribbon cannot tolerate extensive strikeovers which cover or overlap the same ribbon area. Consequently, the ribbons may be used for one pass only which turns out to be a relatively expensive proposition when the cost of manufacturing the ribbon and packaging the ribbon in the ribbon cartridge is considered. Another approach involves the use of ribbon indexing means which step the ribbon through a plurality of vertical positions for each horizontal depth that the ribbon is moved. This requires a relatively expensive ribbon indexing mechanism in the printer.

The apparatus of the present invention achieves maximum utilization of ribbon area with minimal overstrikes or overlaps without ribbon indexing apparatus in the printer.

BRIEF DESCRIPTION OF THE PRESENT INVENTION

It is the primary objective of the present invention to provide apparatus permitting the utilization of vertically adjacent ribbon areas for impact printing without using vertical ribbon indexing apparatus.

It is a further object of the present invention to provide means for utilizing the ribbon in a printer ribbon cartridge for more than just one pass.

It is yet another object of the present invention to provide apparatus facilitating the usage of ribbon in a ribbon cartridge for more than one pass which is both inexpensive and easily implemented.

The present invention accomplishes the above objects by providing a ribbon cartridge adapted to be inserted in receiving means in an impact printer having means for driving the ribbon, said ribbon cartridge being adapted to be reversed one time only. The cartridge comprises a cartridge housing with first and second reels rotatably mounted in said housing, each adapted to support a portion of an inventory of ribbon web driven from one reel to the other reel. The housing includes a keyed tenon projecting from it and having an initial position and a second position; the keyed tenon is switchable from the initial position to the second position but irreversible from said second position.

This ribbon cartridge is operatively associated with receiving means in the impact printer which include means for exclusively receiving the tenon keyed in said initial position wherein the ribbon is driven from said first reel to said second reel and means for exclusively receiving said tenon keyed in said second position wherein the ribbon is driven from the second reel to the first reel.

With the above combination of apparatus, the ribbon can only be driven through an initial pass when the keyed tenon is received in its initial position and the ribbon may be driven for a reverse or second pass only when the tenon being received is keyed in its second position. Since the switch from the first position to the second position is irreversible, it cannot be returned to its initial position. Thus, the tenon receiving apparatus in the printer is incapable of ever receiving the cartridge for any pass beyond the first two passes since such a subsequent pass would again require the ribbon to be driven from the first reel to the second reel which has been made impossible by the irreversible keying of said tenon.

BRIEF DESCRIPTION OF THE DRAWING

Referring now to the drawing, wherein a preferred embodiment of this invention is illustrated, and wherein like reference numerals are used throughout to designate like parts the following is a description of the figures.

BRIEF DESCRIPTION OF THE PREFERRED EMBODIMENT

Figure 1:
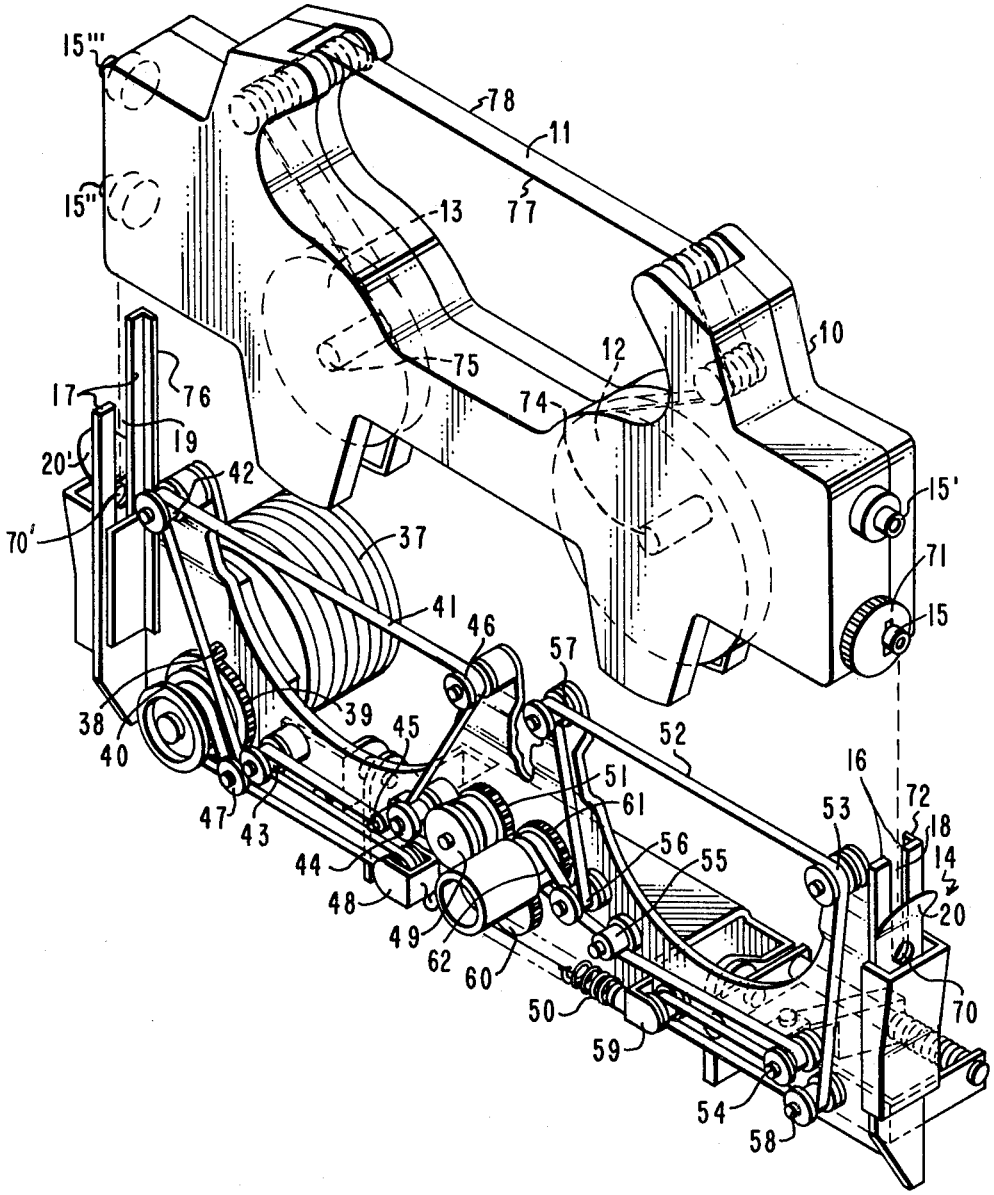
FIG. 1 shows a partial fragmentary perspective view of the ribbon cartridge of the present invention together with an operatively associated impact printer ribbon drive mechanism adapted to receive and drive the ribbon cartridge.
Figure 4:
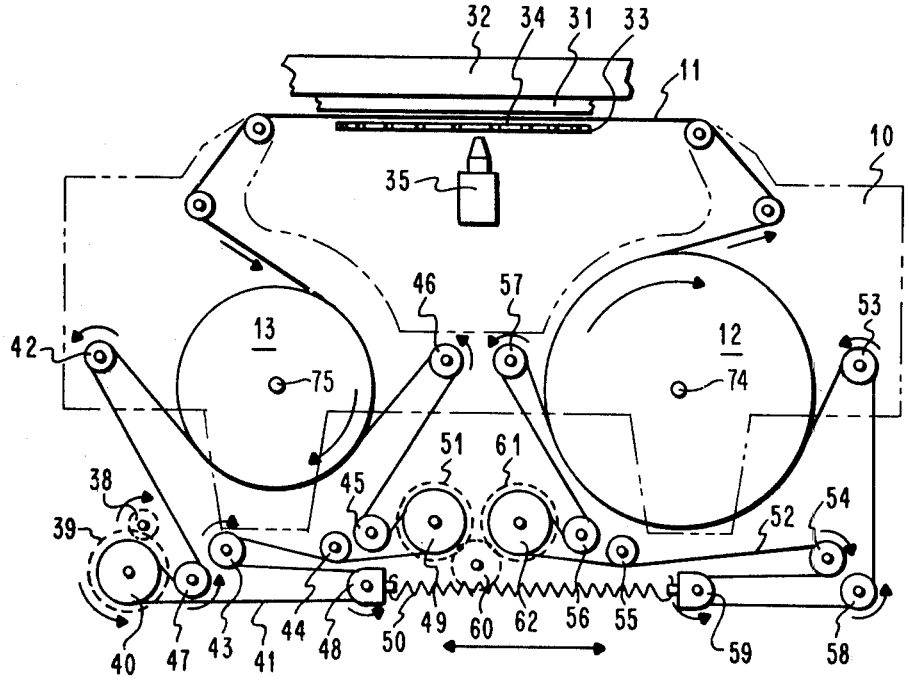
FIG. 4 is a generalized plan view in diagrammatic form of the drive and ribbon mechanism of FIG. 1 associated with a missile type of daisy wheel high speed printer drawn to illustrate the relative movement of the various components during a ribbon driving operation.

FIGS. 1 and 4 show the ribbon cartridge 10 of the present invention operatively associated with the drive mechanism of a co-pending application entitled *Ribbon Drive Mechanism for High Speed Printer,* J. D. Bemis et al, Ser. No. 000,234, filed on Jan. 2, 1979, the same date of the present invention and assigned to a common assignee.

With reference to FIGS. 1 and 4, the ribbon 11 is contained in a cartridge housing 10. The ribbon 11 has a portion 12 on a supply reel 74 and a portion 13 on a take-up reel 75. The ribbon cartridge 10 is shown separated from the ribbon drive mechanism 14 (described in further detail in the referenced co-pending application), both being in the vertical or ribbon cartridge loading-unloading position. When loading or unloading the ribbon cartridge 10, two pairs of cartridge tenons 15, 15', 15", and 15"' are respectively received and guided by two pairs of vertical tabs 16 and 17, respectively, in the drive mechanism 14 which define slots 18 and 19 for receiving and seating the ribbon tenons 15 and 15" as hereinafter described in detail. The tenons 15, 15" are guided along slots 18 and 19 so that tenons 15 and 15" are respectively guided into openings 70 and 70' in cartridge retaining clips 20 and 20' along a path shown in dotted lines. Clips 20 and 20' thus receive and lock the cartridge 10 into position. Spring loaded clips 20 and 20' urge the openings 70 and 70' into engagement with tenons 15, 15" to latch the cartridge 10 into position. In order to unlatch the cartridge 10, clips 20 and 20' may be manually urged away from the cartridge 10 to release the cartridge 10 from the openings 70, 70'. The loading and unloading takes place in the vertical position shown in FIG. 1 after which the mechanism may be rotated as described in the above co-pending application to bring the ribbon 11 and drive mechanism 14 into a horizontal operational position.

With reference to FIGS. 1 and 4, the co-action of the ribbon drive mechanism 14 and the cartridge 10 will now be briefly described. Additional details may be obtained with reference to the above-mentioned co-pending application. When the cartridge 10 is locked in place in the drive mechanism 14, the combined structure will be in the horizontal position with respect to any standard printer platen 32. In this position, the ribbon 11 will be moved past a sheet of printing medium 31 supported on a platen 32. Any conventional impact printing device such as a daisy wheel 33 and hammer 35 or a print character lever or ball will be driven against ribbon 11 to drive the ribbon 11 into the printing medium 31 to form the character to be printed. Now with respect to the ribbon drive apparatus of FIGS. 1 and 4, a stepper motor 37 rotates pinion 38. Pinion 38 drives gear 39 which in turn drives capstan 40 which is fixed to gear 39. Capstan 40 in turn drives take-up drive belt 41 which is guided over pulleys 42, 43, 44, 45, 46 and 47 which serve the function of guide pulleys. In addition, belt 41 is also guided over idler pulley 48 which is connected to spring means 50 to be hereinafter described and over pulley 49 which is affixed to drive gear 51.

With reference to FIG. 4, the path of belt 41 may be described as follows if we proceed along the path shown by the arrows in FIG. 4 commencing with pulley 49. From pulley 49, the belt 41 passes around pulley 45, and then around pulley 46 toward and around pulley 42. Then, it proceeds to and around pulley 47 from which it proceeds to and around capstan 40. From capstan 40, it proceeds to and around idler pulley 48 and then to and around pulley 43. It then proceeds under pulley 44 and back to pulley 49. Supply reel drive belt 52 which is made of the same relatively inelastic material as drive belt 41 is supported and guided over a series of guide pulleys 53 through 58 which correspond to pulleys 42 through 47 associated with the take-up reel drive belt 41. In addition, idler pulley 59 performs a function equivalent to idler pulley 48. Gear 51 drives idler gear 60 which in turn drives gear 61. Pulley 62 fixed to gear 61 is in turn driven and in effect provides the drive for supply reel drive belt 52. Pulleys 49 and 62 are identical except that pulley 62 which is associated with the supply reel drive belt 52 has a slightly smaller diameter than pulley 49. Thus, supply reel drive belt 52 will be driven at a speed slightly slower than take-up reel drive belt 41. Since drive belts 41 and 52, respectively drive ribbon portion 13 on take-up reel 75 and ribbon portion 12 on supply reel 74 in peripheral non-slip driving association, the portion 12 of the ribbon 11 coming off supply reel 74 will be moving at a constant velocity which is slightly less than the portion 13 of ribbon 11 being wound onto take-up reel 75. This will provide a constant strain on ribbon 11 to provide a solution to the needs described hereinabove. With the arrangement shown, this velocity differential will remain constant and consequently the slight strain on the ribbon 11 will also remain constant irrespective of the size of the respective portions 12 and 13 of the ribbon 11 on supply reel 74 or take-up reel 75.

Since drive belts 41 and 52 are substantially inelastic, the total combined length of take-up reel drive belt 41 actually in contact with the ribbon portion 13 periphery on take-up reel 75 and supply reel drive belt 52 in actual contact with the periphery of the ribbon portion 12 on supply reel 74 will remain substantially constant irrespective of changes in the sizes of the ribbon portions 12 and 13 on these two reels 74 and 75. In this respect, spring member 50 and its associated idler pulleys 48 and 59 prevent any slack in drive belts 41 and 51 due to changes in the size of the ribbon portions 13 and 12, respectively on reels 75 and 74. While the other pulleys 42 through 47 and 53 through 58 are fixed, idler pulleys 48 and 59 float, i.e., do not have any fixed position so that they may shift with changes in the size of the ribbon portions 13 and 12 on the respective take-up and supply reels 75 and 74. In this manner, the length of spring 50 remains constant with the position of the spring 50 shifting from right to left in order to compensate for changes in the size of the respective portions 12 and 13 of ribbon on the respective supply and take-up reels 74 and 75.

Figure 2A:
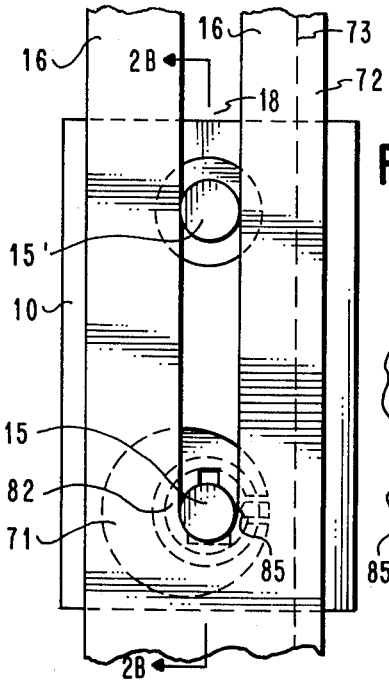
FIG. 2A is an enlarged fragmentary side view of the apparatus of FIG. 1 showing the ribbon cartridge tenon keyed in its first eccentric position together with a portion of the tenon receiving means of said impact printer which exclusively receive the tenon keyed in its initial position.
Figure 2C:
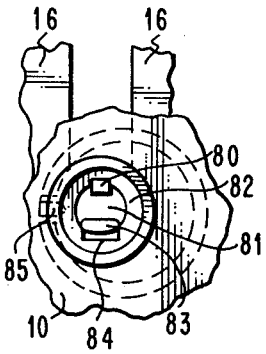
FIG. 2C is a fragmentary bottom view of the structure of FIGS. 2A and 2B taken along lines 2C—2C of FIG. 2B.
Figure 2B:
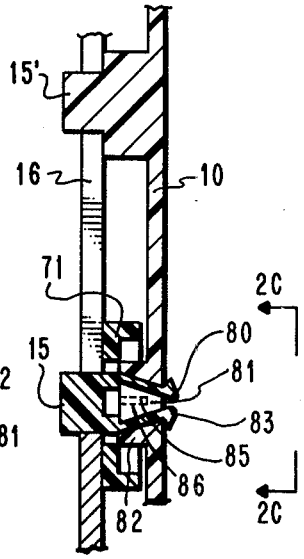
FIG. 2B is a sectional view of the apparatus of FIG. 2A, taken along lines 2B—2B.

Now considering the ribbon cartridge 10 of the present invention more specifically. The cartridge 10 has four tenons 15 through 15"', three of which 15' through 15"' are fixed, and one, 15 has an eccentric key 71 affixed thereto which has two possible positions, the first which is shown in FIG. 1 has the wider portion facing the left edge of the cartridge 10. In this position, the narrower portion of tenon 15 will clear siderail 72 on the right hand vertical tab 16. This may be seen in closer detail in FIG. 2A. In this figure it may be seen that when tenon 15 is keyed in the first eccentric position shown in FIG. 1, edge 73 of siderail 72 is cleared by the narrower end of tenon 15 and tenon 15 is able to move down the track 18 formed by the tab pair 16 into the base position where it will engage clip 20 as previously described in FIG. 1. When tenon 15 is in this initial position, the ribbon drive mechanism 14 will drive the respective ribbon portions 12 and 13 so that the reel 74 on which portion 12 is will act as the supply reel and the reel 75 on which ribbon portion 13 is will act as the take-up reel. In this mode of operation, edge 77 of ribbon 11 will be uppermost and will thus be adjacent to the impact printing means e.g., hammer 35 (FIG. 4) so that the upper half of ribbon 11 adjacent edge 77 will be impacted during the printing operation.

Figure 3A:
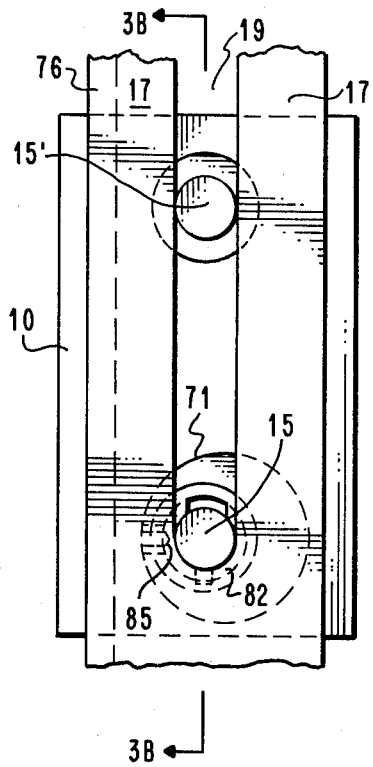
FIG. 3A is an enlarged fragmentary side view of the apparatus of FIG. 1 showing the ribbon cartridge tenon keyed in its second eccentric position together with a portion of the tenon receiving means of said impact printer which exclusively receive the tenon keyed in its second position.

When portion 12 of ribbon 11 on reel 74 becomes exhausted and substantially all of the ribbon 11 is on reel 75, the ribbon 11 may be reversed one time only for one additional pass in the following manner. The cartridge 10 is removed from the drive mechanism by releasing clip 20 and lifting. Keyed eccentric 71 of tenon 15 is then manually rotated 180° which will irreversibly lock this keyed eccentric 71 in the position shown in FIG. 3A. The mechanism for rotating this keyed eccentric 71 and locking the same in the second position will be subsequently described with respect to FIGS. 2B, 2C, 3B and 3C. With keyed eccentric 71 locked in this second position, the larger side of keyed eccentric 71 now faces the right hand side of the cartridge 10. In this position, the cartridge 10 can no longer be received by the receiving means formed by vertical tabs 16 since rail 72 would prevent the keyed eccentric 71 from traveling down the track or slot 18 formed by vertical tabs 16. However, keyed eccentric 71 in this second position will be readily accepted by the receiving means on the other side of the drive mechanism 14 formed by vertical tab pair 17 defining track or slot 19 since siderail 76 will be adjacent to the smaller side of keyed eccentric 71 and tenon 15 will readily slide down slot 19 to engage an opening 70' in clip 20' which is equivalent to opening 70 in clip 20. In this reversed position of cartridge 10 received in drive mechanism 14, reel 75 will now act as the supply reel and reel 74 will act as the take-up reel. Also, as the ribbon 11 is run in this direction, the other half of ribbon 11, i.e., the half adjacent to edge 78 will now be uppermost in the horizontal print position and all of the impact printing will be applied along this half of the ribbon 11. Thus, with this arrangement, the ribbon 11 is used for two passes only, with one-half, i.e., the upper half of the ribbon 11 being used in the first pass and the other or lower half of the ribbon 11 being used on the second pass. In addition, since the second position of keyed eccentric 71 is irreversible, tenon 15 can no longer be inserted in the receiving means formed by vertical tabs 16 for a third or subsequent pass.

Now primarily with reference to FIGS. 2B, 2C, 3B and 3C, we will go into the detail of the locking mechanism for keyed eccentric 71 which permits the eccentric 71 to be rotated 180° from its initial to its second position but irreversibly locks the keyed eccentric 71 into its second or irreversible position. With reference to FIG. *2b* in which keyed eccentric 71 is shown in its initial position with respect to vertical tab 16 of the receiving means which received this tenon 15 when it is in its initial position, narrow leg 80 and wide leg 83 integral with tenon 15 are inserted into opening 81 in receiving projection 82 extending from cartridge housing 10. When tenon 15 is so positioned in its initial position, wide leg 83 is adjacent to slot 84 formed in the inner wall of projection 82. Since wide leg 83 is wider than slot 84, it cannot be received into slot 84 and thus there is no locking effect. With both narrow leg 80 and wide leg 83 being set but not locked within projection 82, a temporary detent is provided through the combination of v-shaped tip or detent 85 which extends from the bottom of keyed eccentric 71 to temporarily engage a corresponding notch 86 formed in the outer wall of projection 82 in a position where keyed eccentric 71 and tenon 15 will be in the initial position.

Figure 3C:
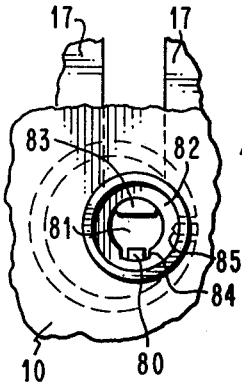
FIG. 3C is a fragmentary bottom view of the structure of FIGS. 3A and 3B taken along lines 3C—3C of FIG. 3B.
Figure 3B:
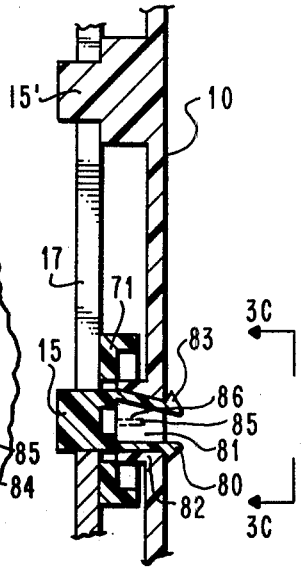
FIG. 3B is a sectional view of the apparatus fragment of FIG. 3A, taken along lines 3B—3B.

When it becomes necessary to reverse the keyed eccentric 71 of tenon 15 to its second position as shown in FIGS. 3B and 3C, a manual rotation of the keyed eccentric 71 with a minor force being necessary to overcome the detenting force of detent 85 and v-shaped groove 86 until the tenon 15 is rotated 180° at which point narrow leg 80 will snap into slot 84 to irreversibly lock the keyed eccentric 71 into the positions shown in FIGS. 3B, 3C, as well as 3A.

While the invention has been particularly shown and described with reference to a particular embodiment, it will be understood by those skilled in the art that various changes in form and detail may be made without departing from the spirit and scope of the invention.

What is claimed is:

1. In an impact printer having means for receiving a ribbon cartridge containing a ribbon and for driving the ribbon in said cartridge, the improvement comprising a ribbon cartridge inserted in said receiving means comprising a cartridge housing, first and second reels rotatably mounted in said housing, each supporting a portion of an inventory of a ribbon web driven from one reel to the other reel, and a keyed tenon projecting from said housing having an initial position and a second position, said keyed tenon being switchable from said initial position to said second position but irreversible from said second position, and wherein said receiving means includes means for exclusively receiving said tenon keyed in said initial position wherein said ribbon is driven from said first reel to said second reel and means for exclusively receiving said tenon keyed in said second position wherein said ribbon is driven from said second reel to first reel.

2. The printer of claim 1 wherein said keyed tenon is mounted at one end of the cartridge and said cartridge further includes at least one tenon having a fixed position at the other end of said cartridge, said keyed tenon is eccentric in its initial and second positions, and said tenon receiving means further include first and second track defining members each having a track defined therein mounted at opposite ends of said ribbon driving means respectively corresponding to said one and other cartridge ends, said first track defining members including a siderail excluding the receipt of a cartridge tenon keyed in said second eccentric position and said second track defining member including a siderail excluding the receipt of a cartridge tenon keyed in said first eccentric position.

3. The printer of claim 2 wherein said cartridge includes means for detenting said keyed tenon in its initial position and means for irreversibly locking said keyed tenon in its second position.

4. The printer of claim 1 wherein said receiving means are disposed so that the ribbon will have a first edge uppermost when said ribbon is being driven from said first reel to said second reel and will have its other edge uppermost when said ribbon is being driven from said second reel to said first reel.

5. The printer of claim 2 wherein said receiving means are disposed so that the ribbon will have a first edge uppermost when said ribbon is being driven from said first reel to said second reel and will have its other edge uppermost when said ribbon is being driven from said second reel to said first reel.

6. A ribbon cartridge containing a ribbon for an impact printer having means for receiving said cartridge and for driving the ribbon in said cartridge, comprising a cartridge housing, first and second reels rotatably mounted in said housing, each supporting a portion of an inventory of a ribbon web driven from one reel to the other reel, and a keyed tenon projecting from said housing and receivable by said receiving means and having an initial position and a second position, said keyed tenon being switchable from said initial position to said second position but irreversible from said second position.

7. The ribbon cartridge of claim 6 wherein said keyed tenon is mounted at one end of the cartridge and said cartridge further includes at least one tenon having a fixed position at the other end of said cartridge and said keyed tenon is eccentric in its initial and second positions.

* * * * *